US006844276B2

(12) United States Patent
Gandhi et al.

(10) Patent No.: US 6,844,276 B2
(45) Date of Patent: Jan. 18, 2005

(54) DYED MICROFIBER TEXTILES

(75) Inventors: Kaushal Gandhi, Spartanburg, SC (US); Benjamin H. Glover, Easley, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/103,235

(22) Filed: Mar. 21, 2002

(65) Prior Publication Data

US 2002/0137419 A1 Sep. 26, 2002

Related U.S. Application Data

(60) Provisional application No. 60/277,840, filed on Mar. 22, 2001.

(51) Int. Cl.[7] ..... B32B 27/12; B32B 27/04

(52) U.S. Cl. ..... 442/164; 442/334; 442/340; 442/351; 8/453; 8/461; 8/465

(58) Field of Search ..... 442/334, 340, 442/351, 59, 164; 8/643, 675, 453, 461, 465

(56) References Cited

U.S. PATENT DOCUMENTS 6,001,936 A * 12/1999 Barrera et al. ..... 525/454
6,117,224 A * 9/2000 Siegel et al. ..... 106/1.43
6,451,234 B1 * 9/2002 Cliver et al. ..... 264/78
6,537,331 B1 * 3/2003 Siemensmeyer et al. ..... 8/471

FOREIGN PATENT DOCUMENTS

JP 07292567 * 11/1995 ..... D06C/19/00

OTHER PUBLICATIONS

JP 03–294580 A (Achilles Corp) Dec. 25, 1991, English Abstract.

JP 05–195451 (Teijin Ltd.) Aug. 3, 1993, English Abstract.

* cited by examiner

*Primary Examiner*—Ula Ruddock
(74) *Attorney, Agent, or Firm*—Terry T. Moyer; Jeffery E. Bacon

(57) ABSTRACT

A nonwoven textile substrate formed from microfibers with a polyuerthane matrix fully and/or partially impregnated therein, a nonazo disperse dye within microfibers, including the surface, and the matrix. The dyed fibers having an L value of about 35 or less, an ΔE light fastness of about 6 or less when subjected to about 225 kilo-joules, and a long term crock of at least about 1.5.

11 Claims, No Drawings

DYED MICROFIBER TEXTILES

PRIORITY

Priority is hereby claimed under 35 USC §119 to copending provisional application Ser. No. 60/277,840, filed on Mar. 22, 2001, which is hereby incorporated herein by specific reference thereto.

BACKGROUND

The present invention generally relates to textiles incorporating microfibers, and in particular, to microfiber textiles which have been through a dyeing procedure to obtain a desired color.

Microfibers are fibers having a denier equal to or less than about 1.0 denier. These fibers can be incorporated into yarns which are formed into fabrics such as woven, knit, nonwoven, or the like. Additionally, these fibers can be incorporated directly into a textile such as a nonwoven.

However, due to the smaller diameter of these fibers, dyes in the textile will have less of a tendency to remain fast in the fabric, and the textile will have a greater susceptibility to fade due to exposure to light. Therefore, there is a need for methods of dyeing microfiber textiles, and the products therefrom, which provide greater light fastness and a lower rate of transfer of color from the fibers to a second object.

DETAILED DESCRIPTION

The present invention generally relates to processes of dyeing textiles, substrates incorporating microfibers, and the resulting products. Textile substrates incorporating microfibers, for use in the present invention can include woven, knitted, nonwoven, bonded, or the like. In one embodiment, the textile is a nonwoven textile formed of microfiber polyester material having a polyurethane matrix partially and/or fully impregnated within the nonwoven textile. A textile dye procedure of the present invention will typically involve two activities: 1) a dye process; and 2) a scouring process.

The dye process generally includes the steps of placing the textile substrate in an bath of dye solutions; increasing the temperature of the bath and textile substrate to a predetermined, dye bath temperature at a certain rate; agitating the substrate within the dye bath for a specified time at the dye bath temperature decreasing the temperature of the dye bath and textile substrate at a certain rate to a predetermined lower level, and rinsing the dyed fabric.

In one embodiment, the dye for the present invention comprises a non-azo dye, such as anthroquinone, benzodifuranone or the like. Additionally, realization of the greatest benefits from the present invention occur when the L value of the color for the dyed textile is equal to or less than 35.

The scour process of the present invention, generally includes the steps of placing the dyed textile substrate within an aqueous bath of alkyl materials, increasing the temperature of the aqueous bath at a certain rate to a predetermined temperature; adding a scouring material to the aqueous bath, scour at the scour temperature agitating the dyed textile substrate within the scouring bath for a specified time at the scour temperature; decreasing the temperature of the dyed textile substrate and scouring bath at a specified rate to a predetermined lower temperature level; and rinsing the dyed and scoured textile. In the process of the present invention, the alkyl materials are added to the aqueous bath at the initial temperature, and the scouring materials are not added to the aqueous bath until the aqueous bath reaches the temperature at which the fabric will be agitated for the specified period. In a preferred embodiment of the present invention, the scouring materials include a reducing agent.

The present invention can be further understood with reference to the following Example. A substrate of nonwoven sanded microfiber impregnated with polyurethane was subjected to a dyeing procedure of a dyeing process and scouring process. The dyeing process included placing 200 pounds of the substrate textile in a 500 gallon bath having dyes and dyeing axularies therein. In the Example, the dyes were Cl disperse red 86 (such as Terasil Pink 2 GLA by Ciba, Inc.), Cl disperse red 159 (such as Dianix Red BLS by Dystar), Cl disperse blue 77 (such as Terasil Blue BLF by Ciba, Inc.), Cl disperse blue 60 (such as Terasil Blue BGF by Ciba, Inc.), and Cl disperse yellow (such as Dorosperse Yellow KHM by D&G, Inc.). Also, in the Example, the dye auxiliaries were Acetic Acid, a leveling agent, a dispersing agent, a de-foamer, and a UV absorber.

The temperature of the dye bath and textile substrate was increased at a rate of about 2° F. per minute until a dye temperature of about 266° F. was reached. The textile substrate and dye bath was agitated through a venturi of a pressure dyeing machine for a period of about 30 minutes. At the end of the 30 minute period, the temperature of the dye bath and textile substrate was decreased at about 2° F. to about 4° F. per minute until the temperature of the dye bath and substrate fabric reached about 120° F. At this point, the textile substrate was rinsed, with water at a temperature of between about 100° F. and about 140° F., and in one embodiment the rinse includes a surfactant.

After the dye process, the dyed textile was subjected to a scour process. The scour process included placing the textile in an aqueous bath of alkyl materials, which included about 2 to about 4 grams of caustic soda per liter of water, and about 4 to about 6 grams of soda ash per liter of water. The aqueous bath of alkyl materials has an initial temperature of about 120° F., and the temperature of the aqueous bath and textile substrate was increased at a rate of about 4° F. per minute until the combination reached a scour temperature of about 170° F. After a time period of about 5 minutes at the scour temperature, a scouring material was added to the aqueous bath. In the Example, the scouring material is a reductive scour of sodium hydrosulfite, added at a rate of about 4 to about 8 grams per liter of the bath. Although sodium hydrosulfite has been used in the Example, it is contemplated by the Example, it is contemplated by the present invention that other reductive scouring materials could be used.

The textile substrate and scouring bath was agitated through the venturi of the pressure dyeing machine for a period of about 30 minutes. After the jet agitation, the temperature of the scour bath and textile substrate were decrease at about 4° F. per minute until a temperature of about 140° F. was obtained. After the temperature was reduced, the textile substrate was subjected to a warm rinse.

The textile resulting from the procedure of the Example was a nonwoven sanded type material formed of microdenier polyester fibers and a polyurethane matrix partially and/or fully impregnated within the nonwoven material. The dye and UV absorber are disposed within microfibers, including the surface, and the matrix. The dye was a non-azo disperse dye, and the dyed textile had an L value of about 35 or less as determined by AATCC Evaluation Procedure 6, Instrument Color Measurement (AATCC Technical Manual/1997), which is hereby incorporated in its entirety herein by specific reference thereto, and which is attached hereto as Appendix I.

The light fastness of the dyed, scoured, and dried textile results in a ΔE of about 6.0 or less at 225 Kilo-joules, as determined by the AATCC Evaluation Procedure 7, Instrumental Assessment of the Change in Color of a Test Specimen (AATCC Technical Manual/1977), using measurements from SAE Test Procedure J 1885 (March 1992), Accelerated Exposure of Automotive Interior Trim Components Using a Controlled Irradience Water Cooled Zenon-Arc Apparatus, on a Zenon Arc Apparatus calibrated to give a ΔE of about 6 to a standard sample Blue Wool Lot Number 5 having a control target ΔE of 6.4 (±0.7). The AATCC Evaluation Procedure 7 and the SAE Test Procedure J 1885, are hereby incorporated in there entirety herein by specific reference thereto.

The textile resulting from the procedure of the Example had a long term crock value of at least 1.5, and typically 2.0 or 2.5. Long term crock is determined by placing a 1 square cm swatch of a dried, dyed and scoured textile face up on a standard filter paper, such as Whatman 7.0 cm #2 qualitative paper. Ten droplets of trichlorethylene from a one millimeter pipette are placed onto the sample and then allowed to dry. The comparison measurement is made between the area of the filter that the solvent wicked from the sample onto the filter paper, and a clean piece of the filter paper. The long term crock is determined by evaluating the Staining Grading according to the MTCC Evaluation Procedure 2, Gray Scale for Staining, (AATCC Technical Manual/1977), which is hereby incorporated in its entirety herein by specific reference thereto.

What is claimed is:

1. A device comprising:

a nonwoven textile substrate having microfibers formed therein and further having a matrix at least partially impregnated therein, the microfibers including exposed surface area;

a non-azo disperse dye disposed in the exposed surface area of the microfibers.

2. The device according to claim 1, wherein the dyed microfibers have an L value of about 35 or less, an ΔE light fastness of about 6 or less when subjected to about 225 kilo-joules, and a long term crock of at least about 1.5.

3. The device according to claim 1, wherein the matrix comprises a polyurethane.

4. The device according to claim 1, wherein the microfibers comprise polyester material.

5. The device according to claim 1, wherein the nonwoven textile substrate further includes a sanded surface.

6. The device according to claim 1, wherein the non-azo dye is selected comprises a dye selected from the group consisting of: anthroquinone, and benzodifuranone.

7. The device according to claim 1, further including a UV absorber disposed in the exposed surface area of the microfibers with the non-azo disperse dye.

8. A device comprising:

a textile substrate having microfibers formed therein and further having a matrix at least partially impregnated therein, the microfibers including exposed surface area;

a non-azo disperse dye disposed in the exposed surface area of the microfibers.

9. The device according to claim 8, wherein the dyed microfibers have an L value of about 35 or less, an ΔE light fastness of about 6 or less when subjected to about 225 kilo-joules, and a long term crock of at least about 1.5.

10. The device according to claim 8, wherein the non-azo dye is selected comprises a dye selected from the group consisting of: anthroquinone, and benzodifuranone.

11. The device according to claim 8, further including a UV absorber disposed in the exposed surface area of the microfibers with the non-azo disperse dye.

* * * * *